US008290419B2

(12) United States Patent
Ogushi

(10) Patent No.: US 8,290,419 B2
(45) Date of Patent: Oct. 16, 2012

(54) IMAGE FORMING SYSTEM AND HUMIDIFICATION DEVICE

(75) Inventor: Takehiro Ogushi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 155 days.

(21) Appl. No.: 12/943,118

(22) Filed: Nov. 10, 2010

(65) Prior Publication Data

US 2011/0116852 A1 May 19, 2011

(30) Foreign Application Priority Data

Nov. 16, 2009 (JP) ..... 2009-260580

(51) Int. Cl.
*G03G 15/20* (2006.01)

(52) U.S. Cl. ..... 399/341

(58) Field of Classification Search ..... 399/341, 399/44, 97, 406, 407
See application file for complete search history.

(56) References Cited

U.S. PATENT DOCUMENTS 5,414,503 A * 5/1995 Siegel et al. ..... 399/406
6,259,887 B1 * 7/2001 Awano ..... 399/390
2003/0091363 A1 * 5/2003 Hoffman et al. ..... 399/92
2004/0042815 A1 * 3/2004 Wayman et al. ..... 399/97
2004/0161254 A1 * 8/2004 Martin et al. ..... 399/67
2009/0190984 A1 * 7/2009 Yamamoto et al. ..... 399/406
2009/0208233 A1 * 8/2009 Hirai ..... 399/60
2011/0069987 A1 * 3/2011 Chang et al. ..... 399/97

FOREIGN PATENT DOCUMENTS

JP 2000-118849 A 4/2000
JP 2007-058026 A 3/2007

* cited by examiner

*Primary Examiner* — Kiho Kim
(74) *Attorney, Agent, or Firm* — Holtz, Holtz, Goodman & Chick, P.C.

(57) ABSTRACT

An image forming system including: an image forming apparatus to perform fixing processing on a sheet based on setting information on a job, and outputs the sheet on which the fixing processing is performed; a humidification device to moisten the sheet outputted from the image forming apparatus, wherein the humidification device including: a pair of humidification rollers to contact with each other so as to form a nip part, and to moisten the sheet which passes through the nip part; a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

12 Claims, 10 Drawing Sheets

HP

HUMIDIFICATION

NO-HUMIDIFICATION

IMAGE FORMING SYSTEM AND HUMIDIFICATION DEVICE

FIELD OF THE INVENTION

The present invention relates to an image forming system and a humidification device.

DESCRIPTION OF THE RELATED ART

An image forming system including a humidification device to humidify sheets of paper is conventionally used. The image forming system has a problem that sheets may be curled or ruffled as a result of moisture taken away from the sheets at a time of heating in a heat-fixing process. To solve the problem, it is proposed to moisten sheets after fixing processing.

For example, there is known a humidification device to humidify sheets by a pair of humidification rollers, wherein the humidification rollers are controlled to be separated from each other in order to make a difference between the amount of moisture added to a sheet and the amount of moisture added to another sheet as small as possible, according to Japanese Patent Application Laid-open Publication No. 2007-58026. There is also known a moistening device (humidification device) including a sprinkler to sprinkle water to sheets and a mechanism by which a shutter is closed when sheets are not moistened, according to Japanese Patent Application Laid-open Publication No.

SUMMARY OF THE INVENTION

In a humidification device in which sheets are moistened by humidification rollers, a period of time for moistening the humidification rollers is not required, but a period of time for drying the humidification rollers is required. Namely, it requires a period of time for changing the state of the humidification rollers from a state where the humidification rollers include moisture (wet condition) to a state where the humidification rollers do not include moisture (dry state). As a result, a problem arises that it takes a long time before starting a job (operation).

For example, there is a case where a job necessary to moisten (humidify) sheets (moistening job) and a job unnecessary to moisten sheets (no-moistening job) are performed, and the moistening job is performed before the no-moistening job. In this case, it requires a period of time for drying the humidification rollers if the humidification rollers are wet when the no-moistening job (operation) starts. Accordingly, the no-moistening job cannot start to be performed until the humidification rollers are dried. As a result a problem arises that it takes a long time to be a state where the no-moistening can be performed.

Japanese Patent Application Laid-open Publications No. 2007-58026 and No. 2000-118849 do not disclose a technology to avoid taking a longtime (shorten a period of time) to be a state where a no-moistening job (job) can be performed.

A first aspect of the present invention is an image forming system including: an image forming apparatus to perform fixing processing on a sheet based on setting information on a job, and outputs the sheet on which the fixing processing is performed; a humidification device to moisten the sheet outputted from the image forming apparatus, wherein the humidification device including: a pair of humidification rollers to contact with each other so as to form a nip part, and to moisten the sheet which passes through the nip part; a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

Preferably, in the image forming system, the timing is one of a timing when the job ends and a timing when an initial operation of the humidification device is completed.

Preferably, in the image forming system, the control section separates the humidification rollers from the water-supply roller so as to perform the dry control of the humidification rollers.

Preferably, in the image forming system, the control section separates the humidification rollers from each other so as to perform the dry control of the humidification rollers.

Preferably, in the image forming system, the humidification device further includes a dry unit to dry the humidification rollers, and the control section drives the dry unit so as to perform the dry control of the humidification rollers.

Preferably, in the image forming system, the humidification device further includes a communication section to communicate with the image forming apparatus, and the control section notifies an instruction to the image forming apparatus via the communication section, the instruction to stop the job for a period of time necessary for the dry operation of the humidification rollers.

A second aspect of the present invention is a humidification device including: a pair of humidification rollers to contact with each other so as to form a nip part, and to moisten a sheet which passes through the nip part; a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

Preferably, in the humidification device, the timing is one of a timing when a job ends and a timing when an initial operation of the humidification device is completed.

Preferably, in the humidification device, the control section separates the humidification rollers from the water-supply roller so as to perform the dry control of the humidification rollers.

Preferably, in the humidification device, the control section separates the humidification rollers from each other so as to perform the dry control of the humidification rollers.

Preferably, in the humidification device, the humidification device further includes a dry unit to dry the humidification rollers, and the control section drives the dry unit so as to perform the dry control of the humidification rollers.

Preferably, in the humidification device, the humidification device further includes a communication section to communicate with an image forming apparatus, and the control section notifies an instruction to the image forming apparatus via the communication section, the instruction to stop a job for a period of time necessary for the dry operation of the humidification rollers.

BRIEF DESCRIPTION OF THE DRAWINGS

The present invention will be understood fully from the detailed description given hereinbelow and the accompanying drawings, which are given by way of illustration only, and thus are not intended as a definition of the limits of the present invention, and wherein.

DESCRIPTION OF THE PREFERRED EMBODIMENT

Hereinafter, an embodiment of the present invention is described in detail referring to the accompanying drawings. However, the scope of the present invention is not limited to the drawings.

Figure 1:
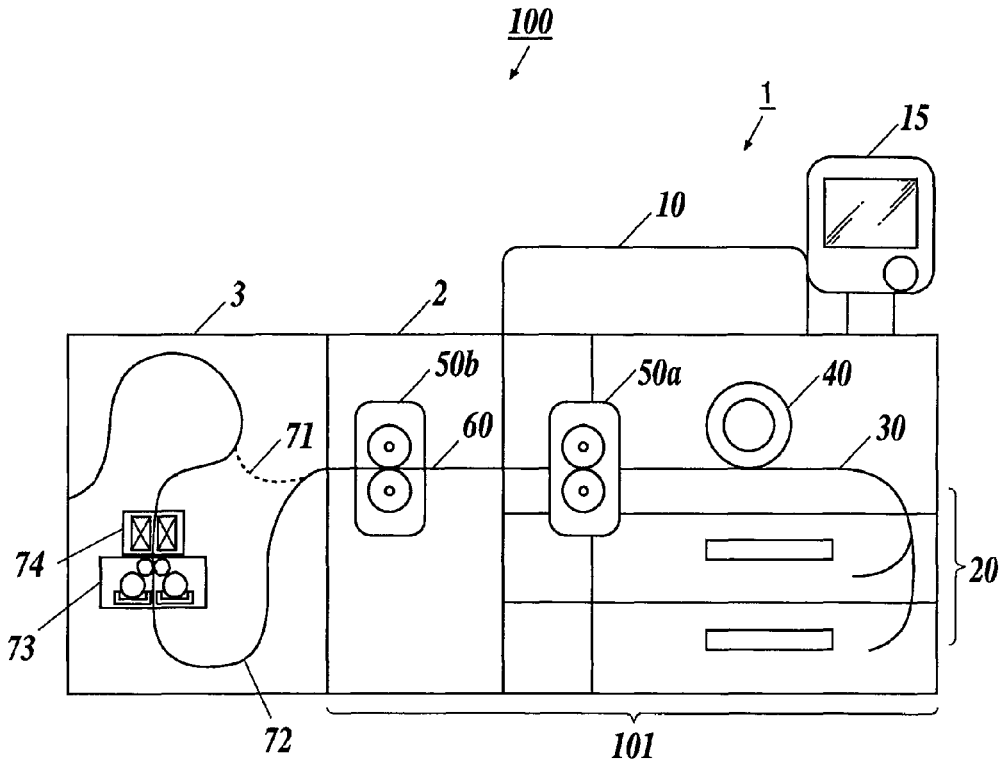
FIG. 1 shows the structure of an image forming system according to an embodiment of the present invention.

An image forming system 100 is described referring to FIG. 1 which is a schematic sectional view showing the structure of the image forming system 100. As shown in FIG. 1, the image forming system 100 includes an image forming device 1, a second fixing device 2, and a humidification device 3. The image forming device 1 and the second fixing device 2 function as an image forming apparatus 101 in the embodiment of the present invention.

First, the image forming device 1 is described. The image forming device 1 includes an image reading section 10, an operation display section 15, a sheet tray section 20, a carrying section 30, an image forming section 40, and a first fixing unit 50*a*.

The image reading section 10 includes an auto document feeder (ADF) and a scanner. The image reading section 10 reads images of documents, and generates image data thereof.

The operation display section 15 includes a liquid crystal display (LCD), a touch panel provided to cover the LCD, and an operation key set (not shown). More specifically, the operation display section 15 receives instructions from a user, and outputs operation signals of the instructions to a CPU 11 (shown in FIG. 2). In addition, the operation display section 15 displays various setting screens to input various operation instructions and setting information, results of various processing, and the like, according to display signals inputted from the CPU 11.

The sheet tray section 20 stores various sheets of paper. The carrying section 30 carries the sheets stored in the sheet tray section 20 to the image forming section 40, and carries the sheets on which images are formed by the image forming section 40 to the first fixing unit 50*a*. Then, the carrying section 30 carries (outputs) the sheets to the second fixing device 2, the sheets on which first fixing processing is performed by the first fixing unit 50*a*.

The image forming section 40 includes a photosensitive drum and tonner bottles of four colors of YMCK (yellow, magenta, cyan, and key (black)). More specifically, the image forming section 40 forms tonner images on the sheets by an electrophotographic process based on job data which is setting information on a job, the sheets which are supplied to the image forming section 40 by the carrying section 30. The job data is inputted from the operation display section 15 or a personal computer (not shown) via a network.

The image forming system 100 according to the embodiment of the present invention is expected to be used in the field of simple printing. Therefore, sheets on which only the first fixing processing is performed (thin paper, for example) and sheets on which the first fixing processing and second fixing processing are performed (thick paper, for example) do not coexist in one job.

The first fixing unit 50*a* performs the first fixing processing by which the tonner images transferred on the sheets are heat-fixed, the sheets which are carried by the carrying section 30. The sheets on which the first fixing processing is performed are carried (outputted) from a carry-out portion of the image forming device 1 to the second fixing device 2 by being held by sheet ejection rollers (not shown) of the carrying section 30.

Next, the second fixing device 2 is described. The second fixing device 2 includes a second fixing unit 50*b* and a carrying section 60.

The second fixing unit 50*b* performs the second fixing processing by which tonner images formed on sheets are heat-fixed.

The above-mentioned fixing processing (the first fixing processing and the second fixing processing) is performed based on the job data. For example, when sheets are thin paper, a message is set in the job data, the message to perform only the first fixing processing by the first fixing unit 50*a*. In this case, only the first fixing processing is performed. Also, for example, when sheets are thick paper, a massage is set in the job data, the massage to perform the first fixing processing and the second fixing processing by the first fixing unit 50*a* and the second fixing unit 50*b*, respectively. In this case, the first fixing processing and the second fixing processing are performed.

The carrying section 60 carries (outputs) the sheets carried from the image forming device 1 to the humidification device 3.

Next, the humidification device 3 is described. The humidification device 3 includes a bypass path 71, a humidification unit path 72, a humidification unit 73, and a dry unit 74.

The bypass path 71 is a carry path which sheets passing through neither the humidification unit 73 nor the dry unit 74 take to be carried. For example, a sheet on which the second fixing processing is not performed by the second fixing unit 50*b* (thin paper, for example) takes the bypass path 71 to be carried.

The humidification unit path 72 is a carry path which sheets passing through the humidification unit 73 and the dry unit 74 take to be carried thereto. For example, a sheet on which the first fixing processing and the second fixing processing are performed (thick paper, for example) takes the humidification unit path 72 to be carried. In this case, the sheet is waxed by the second fixing processing, and it is possible that the wax on the sheet is not dried right away after the second fixing processing is performed thereon. Hence, it is necessary to buy time until the wax on the sheet is fixed (dried). Therefore, as shown in FIG. 1, the carry path, namely, the humidification unit path 72, is made to be long.

The humidification unit 73 is a unit to moisten (humidify) sheets. The dry unit 74 has a function to dry humidification rollers 73*c* in addition to a function to cool sheets.

Figure 2:
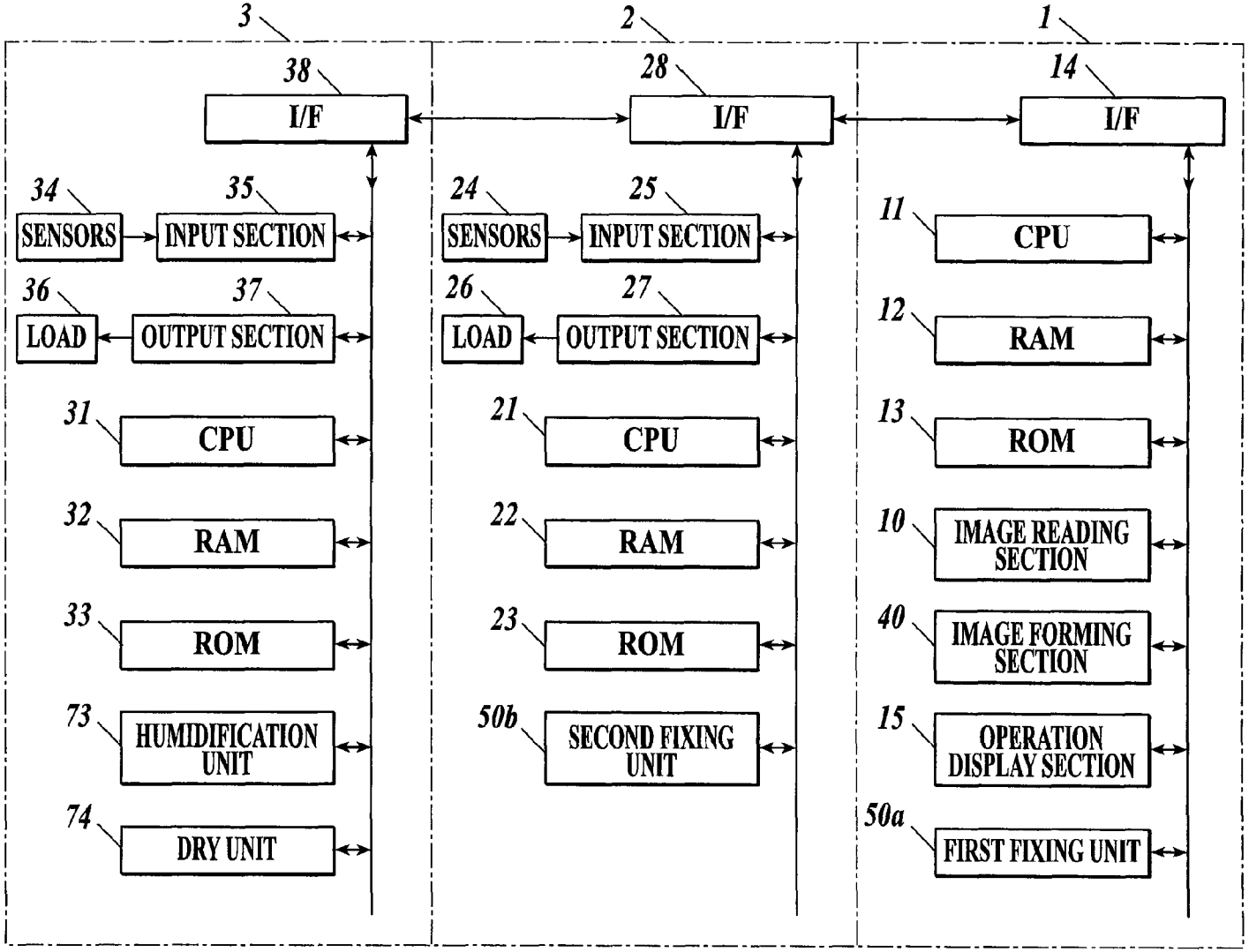
FIG. 2 is a control block diagram of an image forming device, a second fixing device, and a humidification device of the image forming system.

Next, the image forming device 1, the second fixing device 2, and the humidification device 3 are described referring to the control block diagram of FIG. 2. To the sections and the like thereof shown in FIG. 2 which are the same as the sections and the like shown in FIG. 1, the numerals which are the same as the numerals given to the sections and the like shown in FIG. 1 are given. For the descriptions thereof, refer to the descriptions given referring to FIG. 1, and differences therefrom are mainly described in the following.

First, the image forming device 1 is described. The image forming device 1 includes the central processing unit (CPU) 11, a random access memory (RAM) 12, a read only memory (RAM) 13, the image reading section 10, the image forming section 40, the operation display section 15, and the first fixing unit 50*a*.

The CPU 11 reads a program specified from among programs stored in the ROM 13, the programs including a system program and various application programs, expands the read program in the RAM 12, and performs processing in cooperation with the program expanded in the RAM 12, so that centralized control of the sections and the like of the image forming device 1 is performed.

The RAM 12 is a volatile memory, and includes a work area to temporarily store each program of the various programs, the program to be performed by the CPU 11, data for the program, and the like. The ROM 13 stores, for example, the various programs performed by the CPU 11.

Next, the second fixing device 2 is described. The second fixing device 2 includes a CPU 21, a RAM 22, a ROM 23, sensors 24, an input section 25, a load 26, an output section 27, an interface (I/F) 28, and the second fixing unit 50*b*.

The CPU 21, the RAM 22, and the ROM 23 have functions which are the same as the functions of the CPU 11, the RAM 12, and the ROM 13, respectively.

The sensors 24 are various sensors provided in the second fixing device 2. The input section 25 receives input signals from the sensors 24, and outputs the input signals to the CPU 21.

The load 26 includes a motor to drive the sections and the like of the second fixing device 2. The output section 27 outputs instructions from the CPU 21 to the load 26. The interface 28 connects with the image forming device 1 and the humidification device 3 so as to communicate with each other, and transmits and receives various information to/from the image forming device 1 and the humidification device 3 accordingly.

Next, the humidification device 3 is described. The humidification device 3 includes a CPU 31 as a control section, a RAM 32, a ROM 33, sensors 34, an input section 35, a load 36, an output section 37, an interface 38 as a communication section, the humidification unit 73, and the dry unit 74.

The CPU 31, the RAM 32, the ROM 33, the sensors 34, the input section 35, the load 36, the output section 37, and the interface 38 have functions which are the same as the functions of the CPU 11, the RAM 12, the ROM 13, the sensors 24, the input section 25, the load 26, the output section 27, and the interface 28, respectively. In the following, differences therefrom are mainly described.

The CPU 31 controls the humidification rollers 73*c* to be dried (dry control) at a timing when a sheet is not passing through a nip part Ni (shown in FIG. 4) after the humidification rollers 73*c* are moistened by water-supply rollers 73*b*.

The timing when a sheet is not passing through the nip section Ni is a timing when a job ends or a load initial operation (initial operation) of the humidification device 3 is completed.

The dry control is at least one of the followings: control to break contact between the humidification rollers 73*c* and the water-supply rollers 73*b* (separate the humidification rollers 73*c* from the water-supply rollers 73*b*) which are in contact with each other by pressure; control to separate the humidification rollers 73*c* from each other; control to drive fans 74*a* of the dry unit 74; and control to drive the humidification rollers 73*c* to be rotated.

Figure 3:
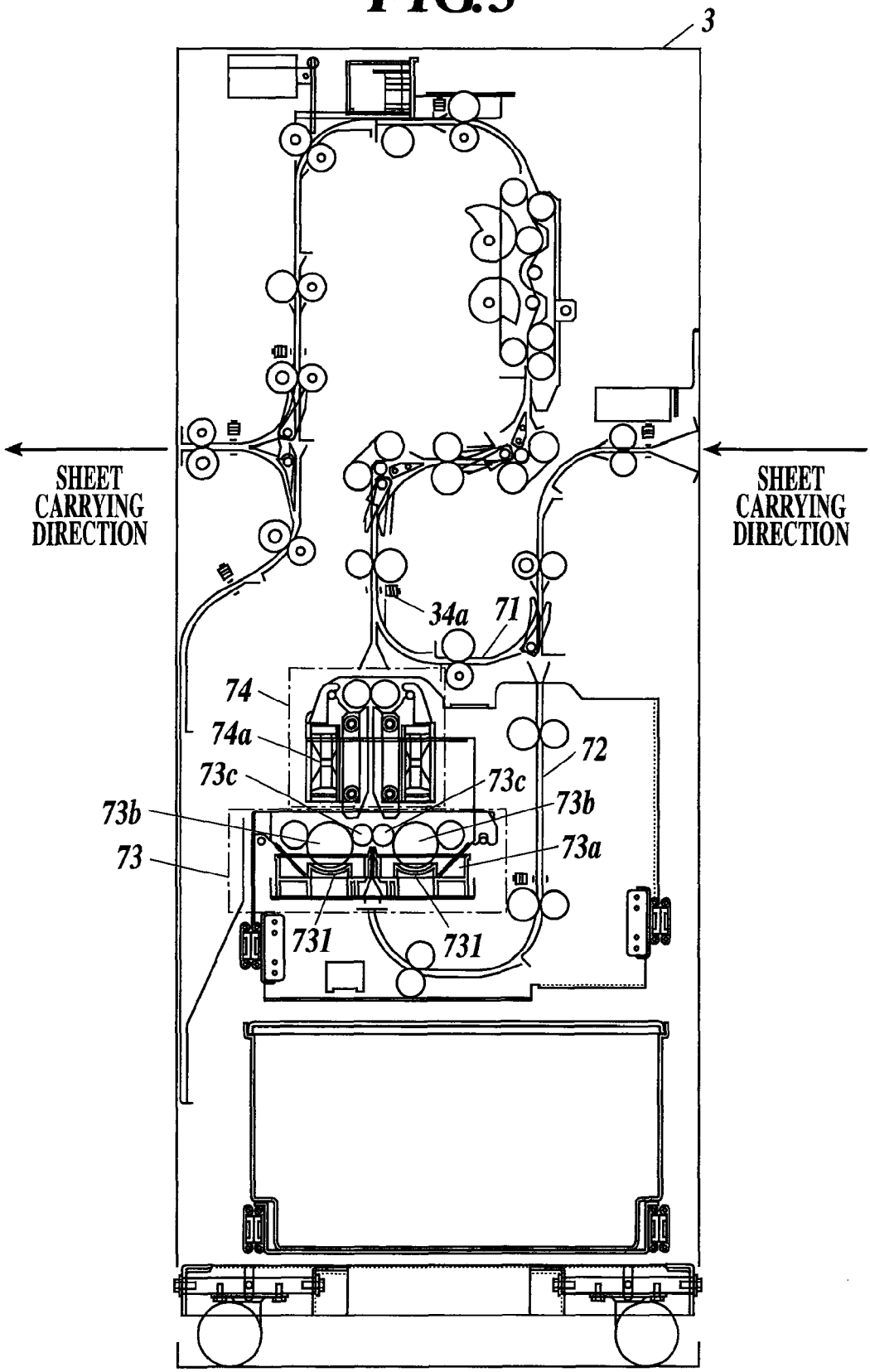
FIG. 3 shows the inner structure of the humidification device.

Next, the structure of the humidification device 3 is described referring to FIG. 3. To the sections and the like thereof shown in FIG. 3 which are the same as the sections and the like shown in FIG. 1, the numerals which are the same as the numerals given to the sections and the like shown in FIG. 1 are given. For the descriptions thereof, refer to the descriptions given referring to FIG. 1, and differences therefrom are mainly described in the following.

As shown in FIG. 3, the humidification device 3 includes the bypass path 71, the humidification unit path 72, the humidification unit 73, the dry unit 74, and a passing sensor 34*a*. In the following, a case is described, the case where sheets are carried from the second fixing device 2 which is placed on the right side of FIG. 3 (namely, the second fixing device 2 is not shown in FIG. 3) to a sheet ejection tray (not shown) which is placed on the left side of FIG. 3.

The humidification unit 73 includes water storage sections 73*a*, the water-supply rollers 73*b*, and the humidification rollers 73*c*.

The water storage sections 73*a* store water to humidify (moisten) sheets. Each of the water storage sections 73*a* includes a water-supply plate 731. The water-supply plate 731 has the inner circumferential surface corresponding to the outer circumferential surface of the cylindrical water-supply roller 73*b*, so that the inner circumferential surface of the water-supply plate 731 is curved so as to be in a shape of an arc of a circle. Passing through a water-supply tube (not shown), water is supplied from a water tank to the water-supply plate 731, the water tank which is placed below the water-supply plate 731. A fixed water level is maintained in the water-supply plate 731 since water overflows when reaching the top of the wall surfaces on the both sides of the water-supply plate 731.

Above the water-supply plate 731, the water-supply roller 73*b* is placed having a prescribed distance from the inner circumferential surface of the water-supply plate 731. The lower part of the water-supply roller 73*b* is accommodated in the water-supply plate 731 so as to be soaked with water.

The water-supply roller 73*b* is composed of a gum roller in which a gum layer is formed around a metal shaft center. The water-supply roller 73*b* contacts with the humidification roller 73*c* (by pressure) so as to supply water (moisture) to the humidification roller 73*c*.

The humidification rollers 73*c* are a pair of rollers, and contact with each other by pressure so as to form the nip part Ni (shown in FIG. 4), and moisten sheets which pass through the nip part Ni. The humidification rollers 73*c* are disposed so as to contact with the water-supply rollers 73*b*, respectively.

The dry unit 74 includes the fans 74*a*. The fans 74*a* have mechanisms to spray air to sheets passing through the dry unit 74 and to the humidification rollers 73*c*.

The passing sensor 34*a* is a sensor to detect that a sheet passes or not.

Figure 4A:
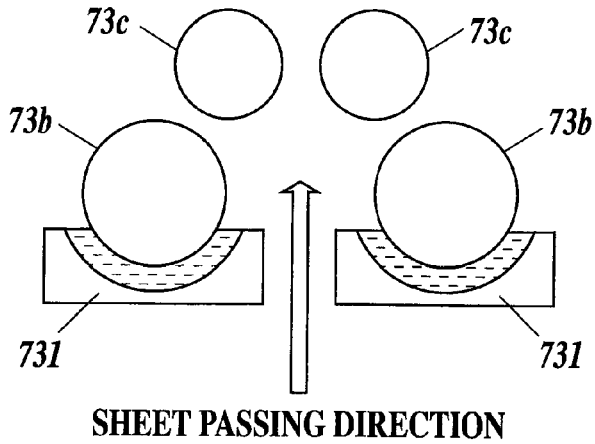
FIG. 4A shows humidification rollers of the humidification device at their home position.
Figure 4B:
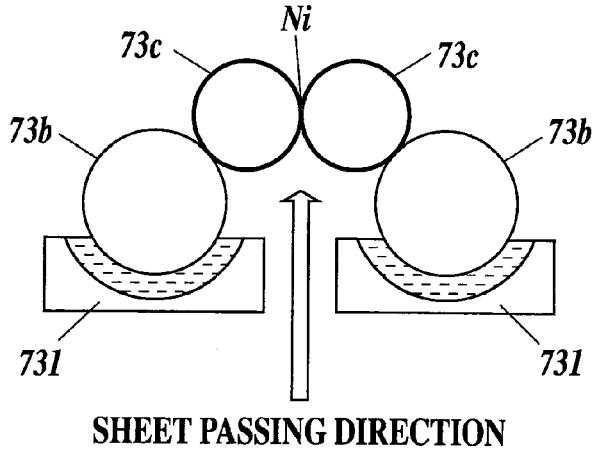
FIG. 4B shows the humidification rollers in humidification.
Figure 4C:
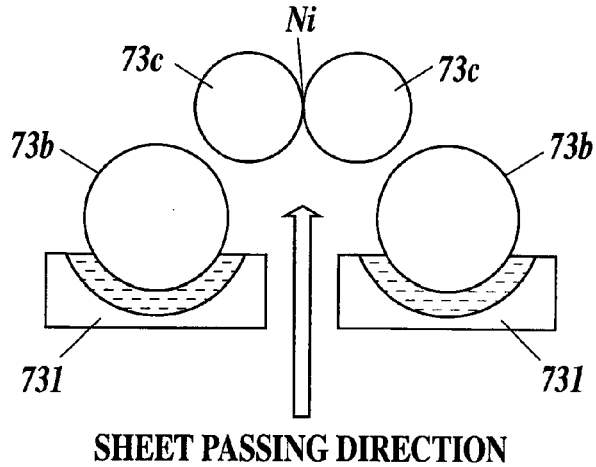
FIG. 4C shows the humidification rollers in no-humidification.

Next, states of the rollers (the water-supply rollers 73*b* and the humidification rollers 73*c*) of the humidification device 3 are described referring to FIGS. 4A, 4B, and 4C.

FIG. 4A shows the rollers at HP (home position). In this case, all the rollers (the water-supply rollers 73*b* and the humidification rollers 73*c*) are separated from each other.

FIG. 4B shows the rollers in humidification. In this case, the humidification rollers 73*c* are driven by a drive section (not shown), and consequently, the humidification rollers 73*c* and the water-supply rollers 73*b* contact with each other, respectively. Accordingly, the humidification rollers 73*c* are wet with water. At the time, the humidification rollers 73*c* contact with each other by pressure so that sheets can be carried, namely, the nip part Ni is formed.

FIG. 4C shows the rollers in no-humidification. In this case, the humidification rollers 73*c* are driven by the drive section (not shown), and consequently, the contact between the humidification rollers 73*c* and the respective water-supply rollers 73*c* by pressure is broken (the humidification rollers 73*c* and the water-supply rollers 73*b* are separated from each other, respectively). At the time, the humidification rollers 73*c* contact with each other by pressure so that sheets can be carried, namely, the nip part Ni is formed.

Figure 5:
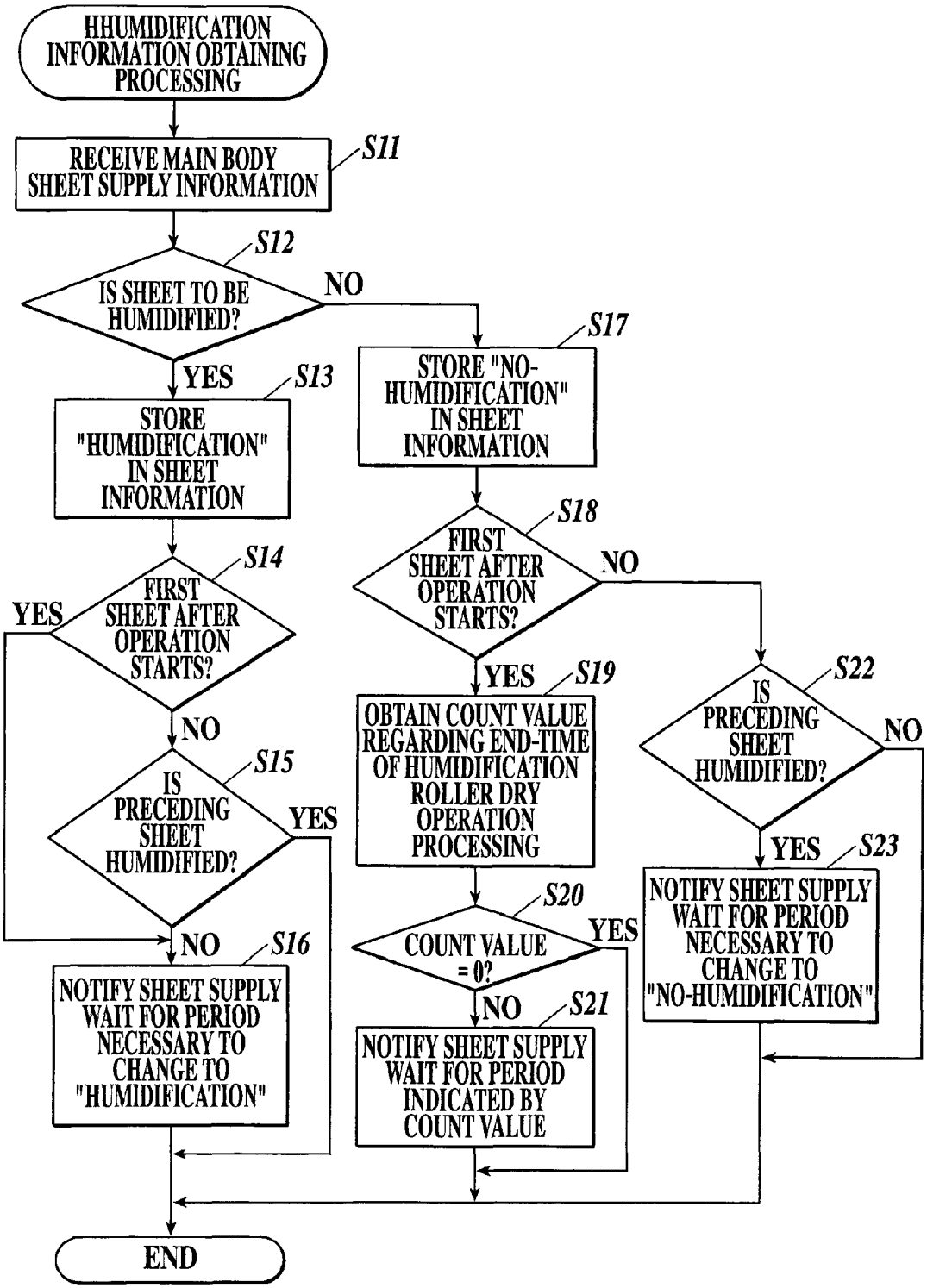
FIG. 5 is a flow chart of humidification information obtaining processing.

Next, humidification information obtaining processing performed at the humidification device 3 is described referring to FIG. 5. The humidification information obtaining processing is processing by which humidification information (information for recognizing whether humidification is to be performed or not) is obtained from the image forming device 1, and a sheet supply wait is notified to the image forming device 1 based on the obtained humidification information.

For example, start of receiving main body sheet supply information at the humidification device 3, the main body sheet supply information sent from the image forming device 1, acts as a trigger for the CPU 31 and a humidification information obtaining program, which is read from the ROM 33 and appropriately expanded in the RAM 32, to perform the humidification information obtaining processing in cooperation with each other.

First, the main body sheet supply information is received (Step S11). The main body sheet supply information is information on sheets (paper type information, humidification information, sheet number information, and the like) supplied from a main body (image forming device 1).

After Step 11, it is judged whether a sheet is to be humidified or not based on the humidification information included in the main body sheet supply information (Step S12). For example, when the humidification information is "humidification", it is judged that the sheet is to be humidified, and when the humidification information is "no-humidification", it is judged that the sheet is not to be humidified.

When it is judged that the sheet is to be humidified at Step S12 (Step S12; YES), "humidification" is stored in sheet information (Step S13). The sheet information is information on a sheet, the information which is set based on the obtained main body sheet supply information. The sheet information is stored in the RAM 32.

After Step S13, it is judged whether the sheet is the first sheet after an operation starts or not (Step S14). More specifically, it is judged whether the sheet on which a job is to be performed is the first sheet after the job starts (first sheet after an operation starts) based on the sheet number information included in the main body sheet supply information.

When it is judged that the sheet is the first sheet after the operation starts at Step S14 (Step S14; YES), the processing moves to Step S16 described below. When it is judged that the sheet is not the first sheet after the operation starts at Step S14 (Step S14; NO), it is judged whether the preceding sheet is humidified or not based on the humidification information included in the main body sheet supply information (Step S15).

When it is judged that the preceding sheet is humidified at Step S15 (Step S15; YES), the humidification information obtaining processing ends.

When it is judged that the preceding sheet is not humidified at Step S15 (Step S15; NO), the sheet supply wait for a period of time necessary to change to "humidification" is notified (Step S16). For example, an instruction (sheet supply wait) to stop a sheet supply operation (instruction to stop the job) for a period of time during which the state of the rollers in no-humidification shown in FIG. 4C changes to the state thereof in humidification shown in FIG. 4B (a period of time during which the humidification rollers 73*c* contact with the respective water-supply rollers 73*b*) is notified to the image forming device 1 via the interface 38. After Step S16, the humidification information obtaining processing ends.

When it is judged that the sheet is not to be humidified at Step S12 (Step S12; NO), "no-humidification" is stored in the sheet information (Step S17). After Step S17, it is judged whether the sheet is the first sheet after an operation starts or not (Step S18).

When it is judged that the sheet is the first sheet after the operation starts at Step S18 (Step S18; YES), a count value of an end-time of humidification roller dry operation processing is obtained (Step S19). Namely, a period of time is obtained as a count value, the period of time necessary to end the humidification roller dry operation processing by which the humidification rollers 73*c* are dried.

After Step S19, it is judged whether the count value is 0 or not based on the count value (Step S20). When it is judged that the count value is 0 at Step S20 (Step S20; YES), the humidification information obtaining processing ends. When it is judged that the count value is not 0 at Step S20 (Step S20; NO), the sheet supply wait for a period of time indicated by the count value is notified (Step S21). Namely, an instruction to stop the sheet supply operation (job) for a period of time indicated by the count value is notified to the image forming device 1 via the interface 38. After Step S21, the humidification information obtaining processing ends.

When it is judged that the sheet is not the first sheet after the operation starts at Step S18 (Step S18; NO), it is judged whether the preceding sheet is humidified or not (Step S22). When it is judged that the preceding sheet is not humidified at Step S22 (Step S22; NO), the humidification information obtaining processing ends.

When it is judged that the preceding sheet is humidified at Step S22 (Step S22; YES), the sheet supply wait for a period of time necessary to change to "no-humidification" is notified (Step S23). For example, an instruction (sheet supply wait) to stop the sheet supply operation (job) for a period of time during which the state of the rollers in humidification shown in FIG. 4B changes to the state thereof in no-humidification shown in FIG. 4C (a period of time during which the humidification rollers 73*c* separate from the respective water-supply rollers 73*b* or a period of time necessary for the dry operation of the humidification rollers 73*c*) is notified to the image forming device 1 via the interface 38. After Step S23, the humidification information obtaining processing ends.

Figure 6:
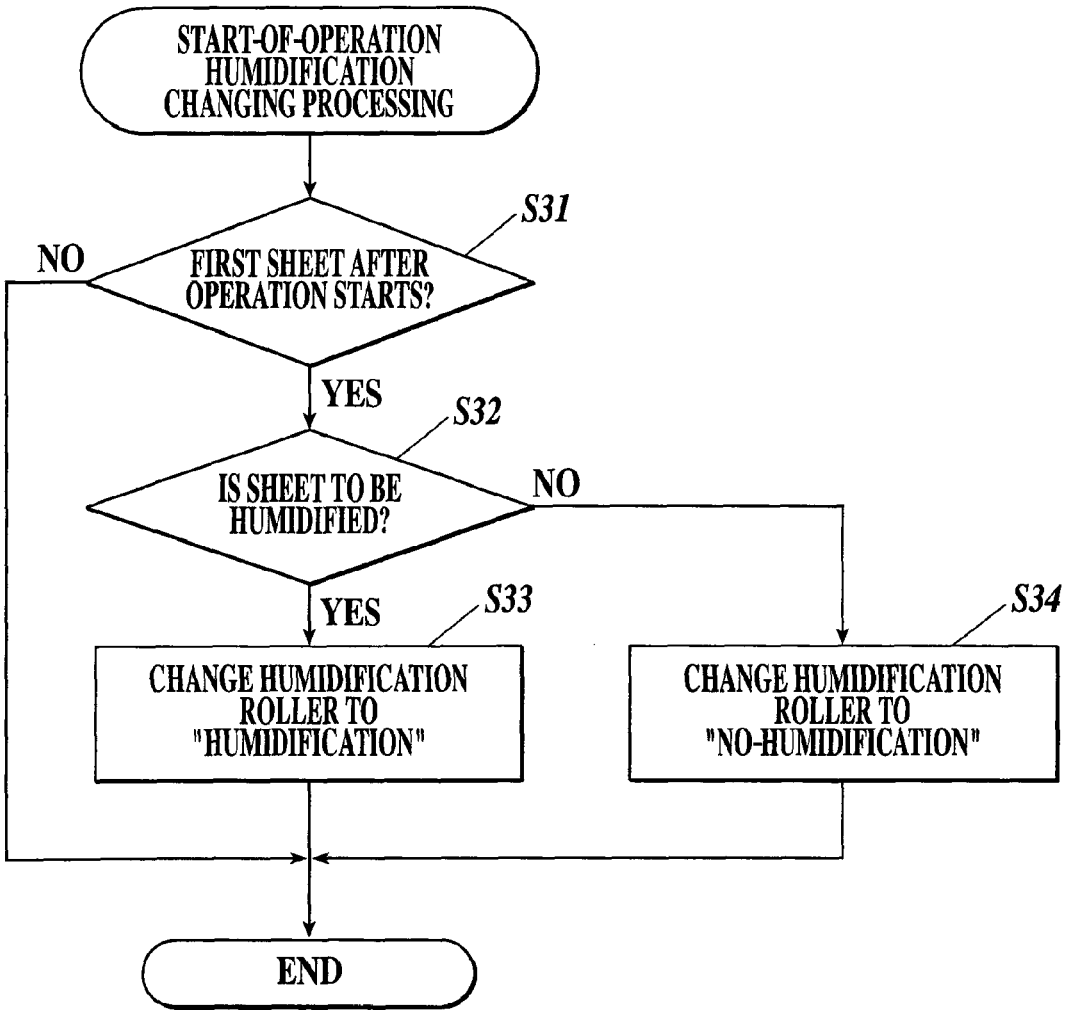
FIG. 6 is a flow chart of start-of-operation humidification changing processing.

Next, start-of-operation humidification changing processing is described referring to FIG. 6. The start-of-operation humidification changing processing is processing by which the humidification rollers 73*c* are controlled to be "humidification" (to be in the state in humidification) or to be "no-humidification" (to be in the state in no-humidification) when the operation (job) starts.

In processing described hereinafter referring to FIGS. 6 to 8, the main body sheet supply information is received from the image forming device 1 in advance.

For example, receiving an instruction to start to perform the start-of-operation humidification changing processing at the humidification device 3, the instruction sent from the image forming device 1, acts as a trigger for the CPU 31 and a start-of-operation humidification changing program, which is read from the ROM 33 and appropriately expanded in the RAM 32, to perform the start-of-operation humidification changing processing in cooperation with each other.

First, it is judged whether a sheet is the first sheet after an operation starts or not (Step S31). When it is judged that the sheet is not the first sheet after the operation starts at Step S31 (Step S31; NO), the start-of-operation humidification changing processing ends.

When it is judged that the sheet is the first sheet after the operation starts at Step S31 (Step S31; YES), it is judged whether the sheet is to be humidified or not (Step S32). When it is judged that the sheet is to be humidified at Step S32 (Step S32; YES), the humidification rollers 73*c* are changed to "humidification" (Step S33). More specifically, the humidification rollers 73*c* move to the position (state) in humidification shown in FIG. 4B. After Step S33, the start-of-operation humidification changing processing ends.

When it is judged that the sheet is not to be humidified at Step S32 (Step S32; NO), the humidification rollers 73*c* are changed to "no-humidification" (Step S34). More specifically, the humidification rollers 73*c* move to the position (state) in no-humidification shown in FIG. 4C. After Step S34, the start-of-operation humidification changing processing ends.

Figure 7:
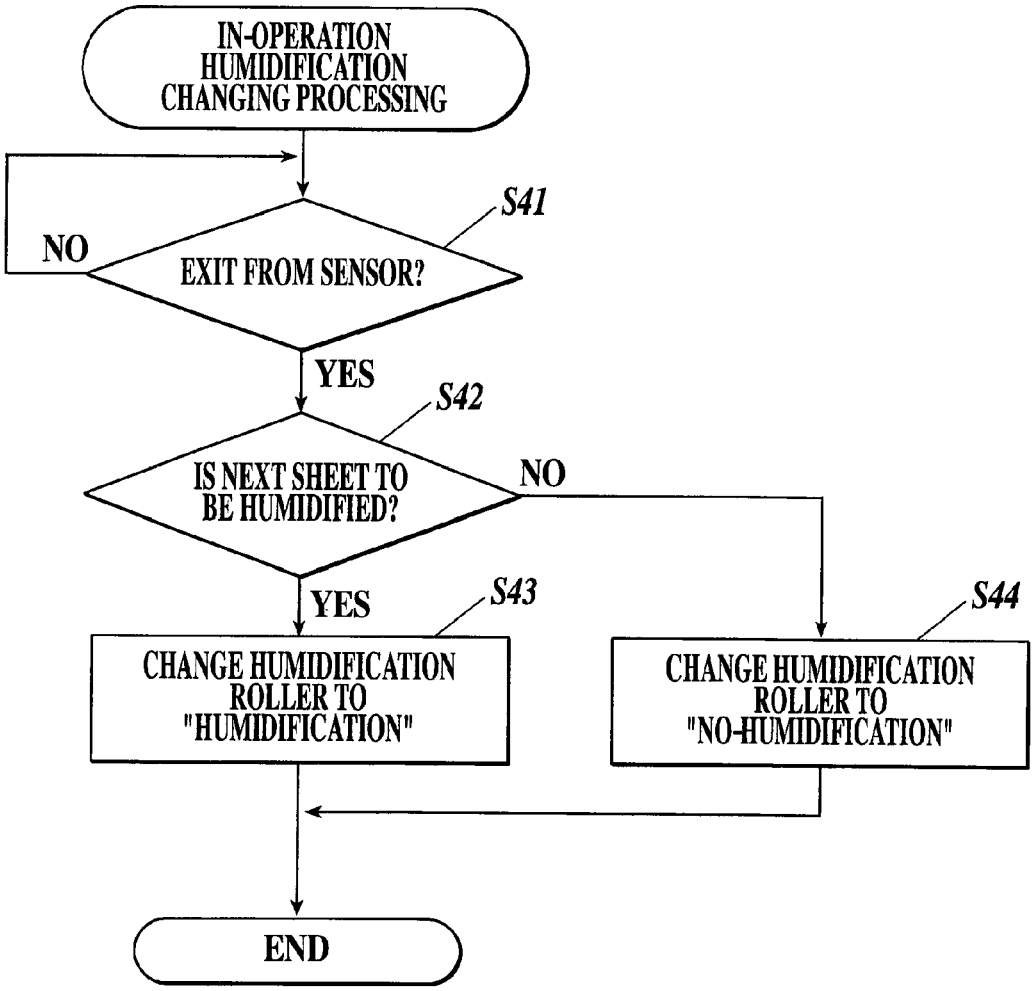
FIG. 7 is a flow chart of in-operation humidification changing processing.

Next, in-operation humidification changing processing is described referring to FIG. 7. The in-operation humidification changing processing is processing by which the humidification rollers 73*c* are controlled to be "humidification" (to be in the state in humidification) or to be "no-humidification" (to be in the state in no-humidification) while an operation (job) is being performed.

For example, receiving an instruction to start to perform the in-operation humidification changing processing at the humidification device 3, the instruction sent from the image forming device 1, acts as a trigger for the CPU 31 and an in-operation humidification changing program, which is read from the ROM 33 and appropriately expanded in the RAM 32, to perform the in-operation humidification changing processing in cooperation with each other.

First, it is judged whether a sheet exits from a sensor or not (Step S41). More specifically, it is judged whether a sheet exits from the passing sensor 34*a* (shown in FIG. 3) or not.

When it is judged that the sheet does not exit from the sensor at Step S41 (Step S41; NO), the processing repeats Step S41. When it is judged that the sheet exits from the sensor at Step S41 (Step S41; YES), it is judged whether the next sheet is to be humidified or not (Step S42). When it is judged that the next sheet is to be humidified at Step S42 (Step S42; YES), the humidification rollers 73*c* are changed to "humidification" (Step S43). After Step S43, the in-operation humidification changing processing ends.

When it is judged that the next sheet is not to be humidified at Step S42 (Step S42; NO), the humidification rollers 73*c* are changed to "no-humidification" (Step S44). After Step S44, the in-operation humidification changing processing ends.

Figure 8:
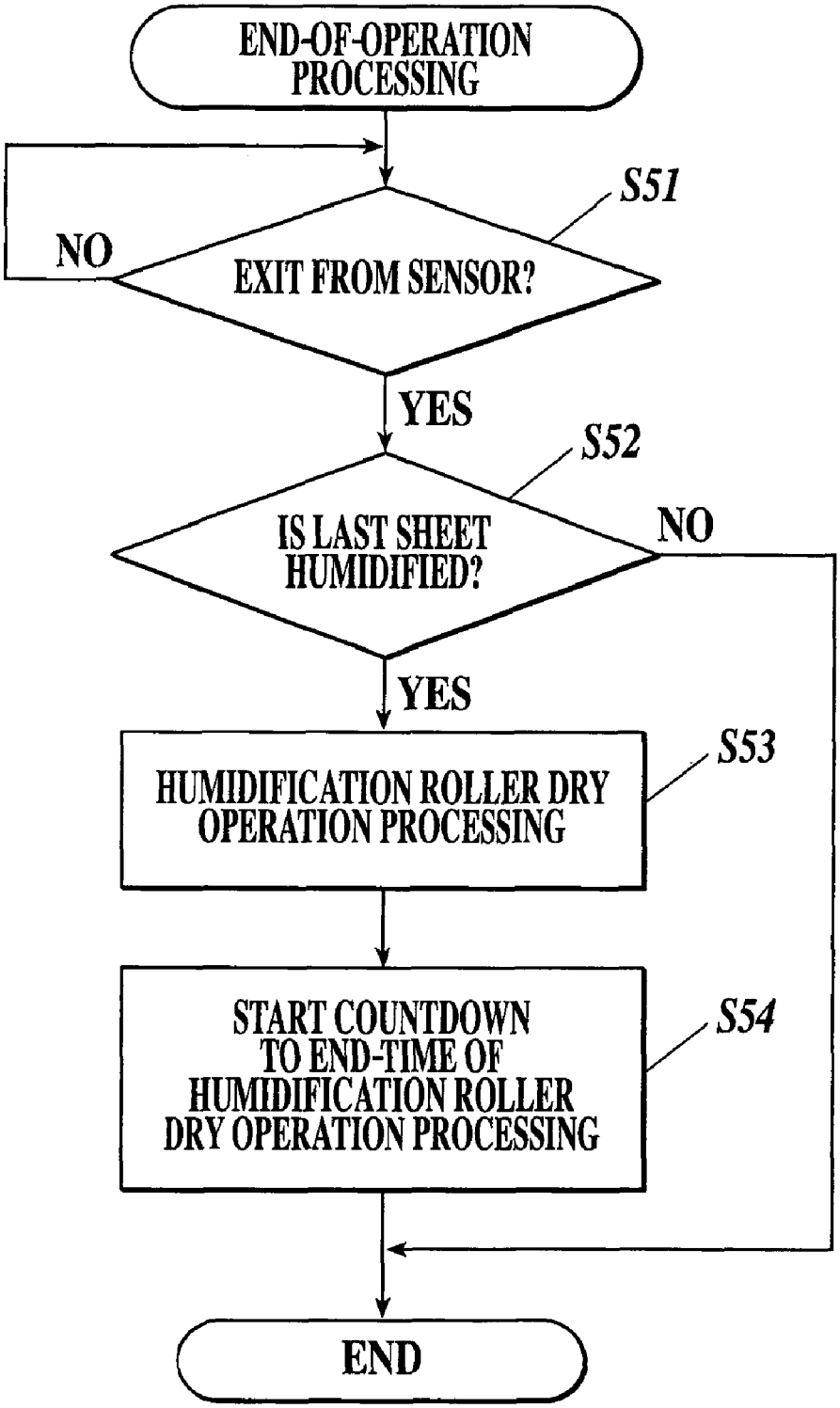
FIG. 8 is a flow chart of end-of-operation processing.

Next, end-of-operation processing is described referring to FIG. 8. The end-of-operation processing is processing by which, for example, seconds and/or minutes until the humidification rollers 73*c* are dried are counted when an operation (job) ends.

For example, receiving an instruction to start to perform the end-of-operation processing at the humidification device 3, the instruction sent from the image forming device 1, acts as a trigger for the CPU 31 and an end-of-operation program, which is read from the ROM 33 and appropriately expanded in the RAM 32, to perform the end-of-operation processing in cooperation with each other.

First, it is judged whether a sheet exits from the sensor or not (Step S51). When it is judged that the sheet does not exit from the sensor at Step S51 (Step S51; NO), the processing repeats Step S51.

When it is judged that the sheet exits from the sensor at Step S51 (Step S51; YES), it is judged whether the last sheet of a job is humidified or not (Step S52). More specifically, Step S52 is judged based on whether or not the CPU 31 receives a signal indicating that the last sheet is humidified by the humidification rollers 73*c*.

When it is judged that the last sheet is not humidified at Step S52 (Step S52; NO), the end-of-operation processing ends.

When it is judged that the last sheet is humidified at Step S52 (Step S52; YES), the humidification roller dry operation processing starts (Step S53). Namely, when humidification of the last sheet is completed (when the job ends), the dry operation of the humidification rollers 73*c* starts. For example, at least one of the following operations starts to be performed: an operation to break contact between the humidification rollers 73*c* and the respective water-supply rollers 73*b* (separate the humidification rollers 73*c* from the respective water-supply rollers 73*b*), which are in contact with each other by pressure; an operation to separate the humidification rollers 73*c* from each other; an operation to drive the fans 74*a* of the dry unit 74; and an operation to drive the humidification rollers 73*c* to be rotated. These operations may be performed at the same time, or may be performed separately.

After Step S53, a countdown to an end-time of the humidification roller dry operation processing starts (Step S54). After Step S54, the end-of-operation processing ends.

Figure 9:
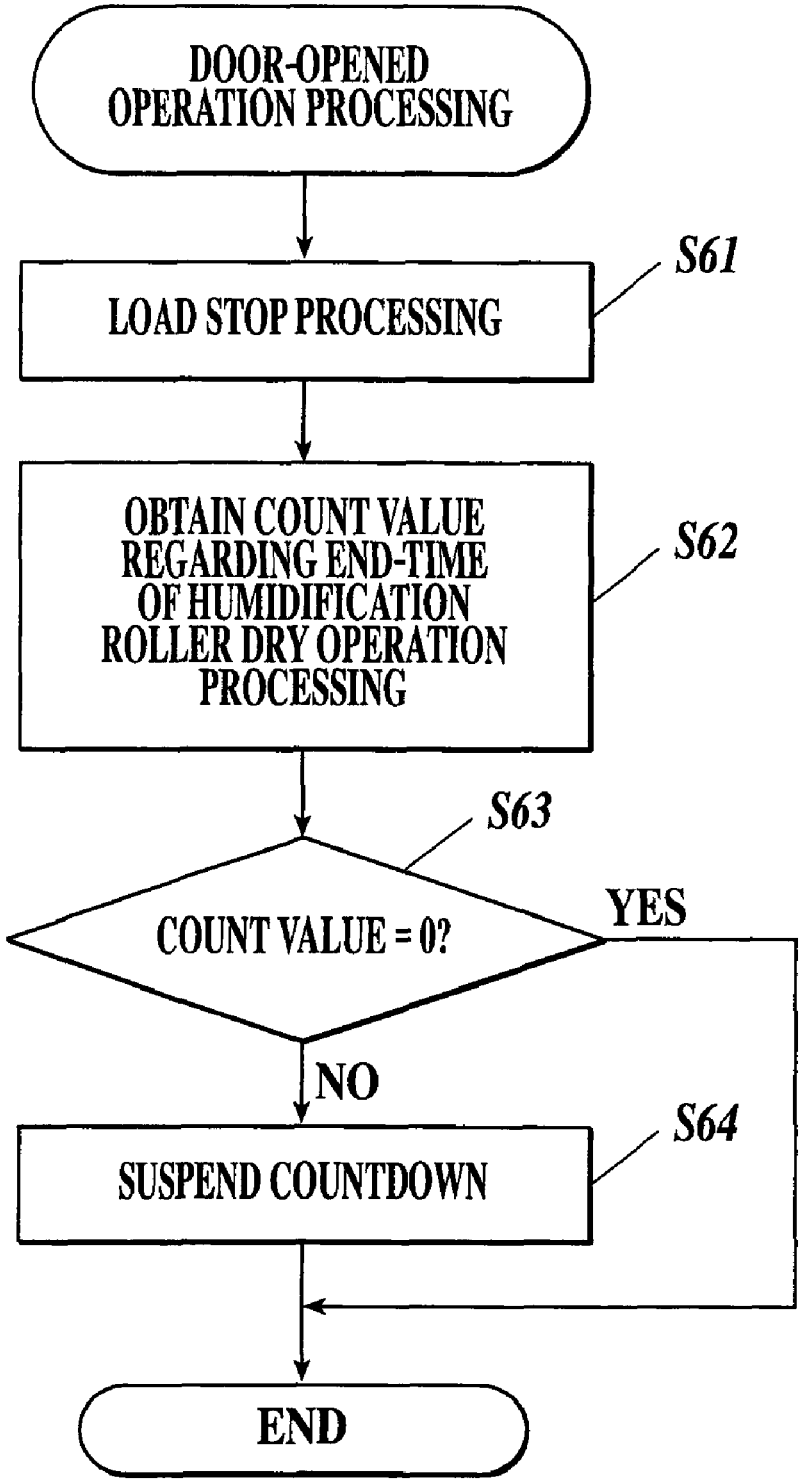
FIG. 9 is a flow chart of door-opened operation processing.

Next, door-opened operation processing is described referring to FIG. 9. The door-opened operation processing is processing by which a count value regarding an end-time of the humidification roller dry operation processing is obtained when a door (not shown) of the humidification device 3 is opened by a user, and a countdown to the end-time thereof is suspended when the count value is not 0. A period of time necessary for the humidification roller dry operation processing, namely, a period of time from a start time of the humidification roller dry operation processing to an end time thereof, is preset.

For example, at the humidification device 3, detecting by one or more of the sensors 34 that the door is opened, and then receiving by the CPU 31*a* detection signal indicating that the door is opened acts as a trigger for the CPU 31 and a door-opened operation program, which is read from the ROM 33 and appropriately expanded in the RAM 32, to perform the door-opened operation processing in cooperation with each other.

First, load stop processing is performed (Step S61). More specifically, processing to stop the load 36 (motor or the like to drive the sections and the like of the humidification device 3) of the humidification device 3 is performed. Then, a count value regarding an end-time of the humidification roller dry operation processing is obtained (Step S62).

After Step S62, it is judged whether the count value is 0 or not (Step S63). When it is judged that the count value is 0 at Step S63 (Step S63; YES), the door-opened operation processing ends.

When it is judged that the count value is not 0 at Step S63 (Step S63; NO), measuring an end-time of the humidification roller dry operation processing with a timer of the humidifying device 3 is suspended (Step S64). Namely, a countdown to the end-time thereof is suspended. After Step S64, the door-opened operation processing ends.

Figure 10:
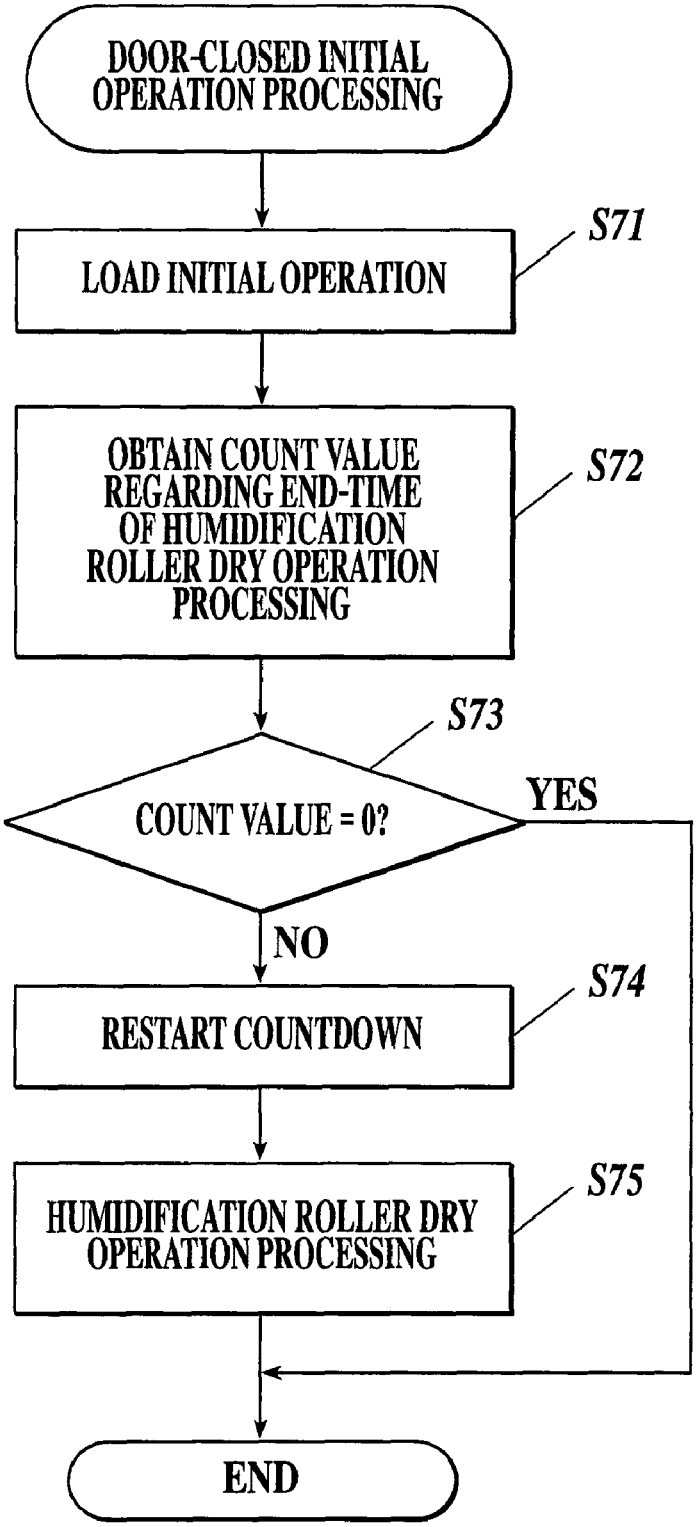
FIG. 10 is a flow chart of door-closed initial operation processing.

Next, door-closed initial operation processing is described referring to FIG. 10. The door-closed initial operation processing is processing by which a count value regarding an end-time of the humidification roller dry operation processing is obtained after the load initial operation (initial operation) is completed, and a countdown to the end-time thereof starts when the count value is not 0 so that the dry operation of the humidification rollers 73*c* continues.

For example, at the humidification device 3, detecting by one or more of the sensors 34 that the door is closed, and then receiving by the CPU 31*a* detection signal indicating that the door is closed acts as a trigger for the CPU 31 and a door-closed initial operation program, which is read from the ROM 33 and appropriately expanded in the RAM 32, to perform the door-closed initial operation processing in cooperation with each other.

The door-opened operation processing shown in FIG. 9 is performed in advance.

First, the load initial operation is performed (Step S71). More specifically, the initial operation of the humidification device 3 is performed. Then, a count value regarding the end-time of the humidification roller dry operation processing is obtained (Step S72).

After Step S72, it is judged whether the count value is 0 or not (Step S73). When it is judged that the count value is 0 at Step S73 (Step S73; YES), the door-closed initial operation processing ends.

When it is judged that the count value is not 0 at Step S73 (Step S73; NO), measuring the end-time of the humidification roller dry operation processing with the timer starts (Step S74). Namely, the countdown to the end-time of the humidification roller dry operation processing, the countdown which is suspended by the door-opened operation processing, starts (re-starts). Then, the humidification roller dry operation processing is performed (Step S75). Namely, the dry operation of the humidification rollers 73*c* is performed after the load initial operation is completed. When, for example, the humidification rollers 73*c* are separated from the respective water-supply rollers 73*b* at the time, the dry operation such as driving the fans 74*a* and/or driving the humidification rollers 73*c* to be rotated is performed (re-starts) with the state where the humidification rollers 73*c* are separated from the respective water-supply rollers 73*b* kept. After Step S75, the door-closed initial operation processing ends.

As described above, according to the embodiment of the present invention, the dry control of the humidification rollers 73*c* is performed at the timing when a sheet is not passing through the nip part Ni which is formed by the humidification rollers 73*c*, so that drying the humidification rollers 73*c* can start without wasting time. Consequently, the humidification rollers 73*c* of the humidification device 3 can be dried earlier than humidification rollers of a conventional humidification device. As a result, a period of time necessary for a humidification device to be in a state where a job can be performed can be shortened. For example, when a no-moistening job is performed, and drying the humidification rollers 73*c* is necessary, the humidification rollers 73*c* of the humidification device 3 can be dried earlier than humidification rollers of a conventional humidification device. As a result, a period of time necessary for a humidification device to be in a state where a job can be performed can be shortened.

When the load initial operation (initial operation) of the humidification device 3 is performed, drying the humidification rollers 73*c* starts when the initial operation is completed. Therefore, the humidification rollers 73*c* of the humidification device 3 can be dried earlier than humidification rollers of a conventional humidification device. As a result, a period of time necessary for a humidification device to be in a state where a job can be performed can be shortened.

The humidification rollers 73*c* can be dried by at least one of the followings: breaking contact between the humidification rollers 73*c* and the respective water-supply rollers 73*b* (separating the humidification rollers 73*c* from the respective water-supply rollers 73*b*), which are in contact with each other by pressure; separating the humidification rollers 73*c* from each other; and driving the fans 74*a* of the dry unit 74.

A job is stopped for a period of time necessary for the dry operation of the humidification rollers 73*c*. Consequently, for example, even when a request to perform the next job is made during the dry operation of the humidification rollers 73*c*, the next job is not performed during the dry operation thereof, so that it can be prevented that a job is performed before the humidification rollers 73*c* are dried.

The embodiment of the present invention described above is an example of the image forming system and the humidification device of the present invention, and the present invention is not limited to the embodiment.

For example, in the embodiment described above, closing the door of the humidification device 3 acts as a trigger to perform the load initial operation. However, this is not a limit. For example, the load initial operation may be performed when power of the image forming device 1 is turned on, and the following steps (Steps S72 to S75) may be performed.

The detailed structures and operations of the image forming system and the humidification device according to the embodiment of the present invention can be appropriately modified without departing from the scope of the present invention.

According to a first aspect of the embodiment of the present invention, there is provided an image forming system including: an image forming apparatus to perform fixing processing on a sheet based on setting information on a job, and outputs the sheet on which the fixing processing is performed; a humidification device to moisten the sheet outputted from the image forming apparatus, wherein the humidification device including: a pair of humidification rollers to contact with each other so as to form a nip part, and to moisten the sheet which passes through the nip part; a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

Accordingly, a period of time required to be a state where a job can be performed can be shortened.

Preferably, the timing is one of a timing when the job ends and a timing when an initial operation of the humidification device is completed.

Preferably, the control section separates the humidification rollers from the water-supply roller so as to perform the dry control of the humidification rollers.

Preferably, the control section separates the humidification rollers from each other so as to perform the dry control of the humidification rollers.

Preferably, the humidification device further includes a dry unit to dry the humidification rollers, and the control section drives the dry unit so as to perform the dry control of the humidification rollers.

Preferably, the humidification device further includes a communication section to communicate with the image forming apparatus, and the control section notifies an instruction to the image forming apparatus via the communication section, the instruction to stop the job for a period of time necessary for the dry operation of the humidification rollers.

According to a second aspect of the embodiment of the present invention, there is provided a humidification device including: a pair of humidification rollers to contact with each other so as to form a nip part, and to moisten a sheet which passes through the nip part; a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

Accordingly, a period of time required to be a state where a job can be performed can be shortened.

Preferably, the timing is one of a timing when a job ends and a timing when an initial operation of the humidification device is completed.

Preferably, the control section separates the humidification rollers from the water-supply roller so as to perform the dry control of the humidification rollers.

Preferably, the control section separates the humidification rollers from each other so as to perform the dry control of the humidification rollers.

Preferably, the humidification device further includes a dry unit to dry the humidification rollers, and the control section drives the dry unit so as to perform the dry control of the humidification rollers.

Preferably, the humidification device further includes a communication section to communicate with an image forming apparatus, and the control section notifies an instruction to the image forming apparatus via the communication section, the instruction to stop a job for a period of time necessary for the dry operation of the humidification rollers.

The present U.S. Patent Application claims priority from Japanese Patent Application No. 2009-260580 filed with Japan Patent Office on Nov. 16, 2009, under the Paris Convention for the Protection of Industrial Property, and the Japanese Patent Application is a ground for correction of mistakes in translation of the present U.S. patent application.

What is claimed is:

1. An image forming system comprising:

an image forming apparatus to perform fixing processing on a sheet based on setting information on a job, and outputs the sheet on which the fixing processing is performed;

a humidification device to moisten the sheet outputted from the image forming apparatus, wherein the humidification device including:

a pair of humidification rollers to contact with each other so as to form a nip part, and to moisten the sheet which passes through the nip part;

a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

2. The image forming system according to claim 1, wherein the timing is one of a timing when the job ends and a timing when an initial operation of the humidification device is completed.

3. The image forming system according to claim 1, wherein the control section separates the humidification rollers from the water-supply roller so as to perform the dry control of the humidification rollers.

4. The image forming system according to claim 1, wherein the control section separates the humidification rollers from each other so as to perform the dry control of the humidification rollers.

5. The image forming system according to claim 1, wherein the humidification device further includes a dry unit to dry the humidification rollers, and the control section drives the dry unit so as to perform the dry control of the humidification rollers.

6. The image forming system according to claim 1, wherein the humidification device further includes a communication section to communicate with the image forming apparatus, and the control section notifies an instruction to the image forming apparatus via the communication section, the instruction to stop the job for a period of time necessary for the dry operation of the humidification rollers.

7. A humidification device comprising:

a pair of humidification rollers to contact with each other so as to form a nip part, and to moisten a sheet which passes through the nip part;

a water-supply roller to contact with the humidification rollers so as to supply moisture to the humidification rollers; and a control section to perform dry control of the humidification rollers at a timing when the sheet does not pass through the nip part after the water-supply roller supplies the moisture to the humidification rollers.

8. The humidification device according to claim 7, wherein the timing is one of a timing when a job ends and a timing when an initial operation of the humidification device is completed.

9. The humidification device according to claim 7, wherein the control section separates the humidification rollers from the water-supply roller so as to perform the dry control of the humidification rollers.

10. The humidification device according to claim 7, wherein the control section separates the humidification rollers from each other so as to perform the dry control of the humidification rollers.

11. The humidification device according to claim 7, wherein the humidification device further includes a dry unit to dry the humidification rollers, and the control section drives the dry unit so as to perform the dry control of the humidification rollers.

12. The humidification device according to claim 7, wherein the humidification device further includes a communication section to communicate with an image forming apparatus, and the control section notifies an instruction to the image forming apparatus via the communication section, the instruction to stop a job for a period of time necessary for the dry operation of the humidification rollers.

* * * * *